United States Patent [19]

Jackson

[11] Patent Number: 4,817,295

[45] Date of Patent: Apr. 4, 1989

[54] HOT AIR INDUCTION BOX

[76] Inventor: Samuel G. Jackson, P.O. Box 16587, Lubbock, Tex. 79490

[21] Appl. No.: 83,737

[22] Filed: Aug. 7, 1987

[51] Int. Cl.[4] ..... F26B 17/00

[52] U.S. Cl. ..... 34/57 R; 34/92; 34/182; 34/236

[58] Field of Search ..... 34/92, 182, 236, 57 R

[56] References Cited

U.S. PATENT DOCUMENTS

| | | | |
|---|---|---|---|
| 2,035,716 | 3/1936 | Peek | 34/182 |
| 2,189,099 | 2/1940 | Bennett | 34/57 R |
| 2,483,254 | 9/1949 | Almy | 34/92 X |
| 2,528,476 | 10/1950 | Rees et al. | 34/92 |
| 3,069,730 | 12/1962 | Sandergriff | 34/57 R |
| 4,324,053 | 4/1982 | Carpenter | 34/236 |
| 4,580,355 | 4/1986 | Boissevain | 34/155 X |

*Primary Examiner*—Steven E. Warmer

*Attorney, Agent, or Firm*—Charles D. Gunter

[57] ABSTRACT

A hot air induction box is shown which includes an enclosure surrounding the point at which seed cotton or other fibrous material is sucked up from a belt conveyor or chute. The entrance into the enclosure through which the fibrous material passes is restricted by a horizontally pivoted door. This door is counterweighted in such a manner that it restricts the necessary entrance of the air used for conveying and induces a partial vacuum within the enclosure. The partial vacuum thus formed is adequate to pull hot air from an air heater into the enclosure where it becomes a substantial portion of the conveying air.

8 Claims, 3 Drawing Sheets

HOT AIR INDUCTION BOX

BACKGROUND OF THE INVENTION

1. Field of the Invention

The present invention relates generally to devices and methods for introducing hot air into pneumatic conveying systems, and specifically to an induction box for introducing hot air into a stream of seed cotton being pneumatically conveyed along a path to a cotton gin.

2. Description of the Prior Art

In the United States, seed cotton is brought to the cotton gin in two different ways. If it is brought to the gin in trailers, it will normally be unloaded and delivered into the gin pneumatically using a suction telescope. The seed cotton may also be brought to the cotton gin in the form of modules, which are compacted blocks of seed cotton about 8 feet wide, 8 feet high and 32 feet long. Modules can be fed into the cotton gin by using the conventional suction telescope, but a module feeder is more commonly used for this purpose.

The module feeder has a disperser which operates on the end of the module to disintegrate the module so the seed cotton can be conveyed and processed in the usual manner. The disperser progresses through the module at a controlled speed in order to produce the desired flow rate of seed cotton into the gin. In one type of feeder, the module is placed on a moving bed which feeds it into a stationary disperser.

Another type places the modules end to end on a long concrete slab. The disperser moves along this slab chewing up the modules and delivering the fractionated seed cotton into a belt conveyor alongside the slab. At the end of the conveyor, the seed cotton is picked up pneumatically from the belt to be taken into the cotton gin. The velocity of the air used to pick up the seed cotton can be adjusted so that only seed cotton is picked up, leaving rocks and green bolls on the belt. These travel into another conveyor for different disposition.

It is a common occurrence for the harvested seed cotton, whether in trailers or in modules, to be exposed to rain or snow before it is ginned. This is more often a problem with modules because they are sometimes left in the fields for several weeks before the cotton gin is ready to receive them. Such wet seed cotton is difficult to convey pneumatically, and the wet fiber tends to clog the perforations in the device which separates the conveying air from the incoming seed cotton. It is obviously desirable to use hot air for the first transport of the seed cotton in order to dry it somewhat.

Hot air has been used in this manner in some instances. Heretofore, it has been considered necessary to pass the seed cotton through a rotary air lock at its entrance into the stream of hot air. Such installations have usually involved module feeders with stationary dispersers in which the rotary air lock was installed in a pit below the disperser.

Where the moving disperser is used, it has been possible to do this, but with significant disadvantages. In some installations, a rotary air lock has been installed in a pit below the discharge end of the belt conveyor. This involves not only the expense of constructing the pit but the danger of its flooding in rainy weather. More significant is the loss of ability to leave the rocks and green bolls outside the gin.

SUMMARY OF THE INVENTION

The hot air induction box of the invention is used to heat seed cotton which is being transported by conveyance means along a path to a cotton gin. The induction box includes an enclosure surrounding a portion of the path used by the conveyance means. The enclosure has sidewalls which define a closed interior with an entrance opening and a cotton exit. Suction means, connected to the enclosure, pneumatically draw seed cotton from the conveyance path, through the enclosure and out the cotton exit. A heating duct connects the enclosure to a source of hot air. Gate means partially restrict the entrance opening to the enclosure to thereby create a partial vacuum within the enclosure, the vacuum so created being effective to pull hot air into the enclosure through the heating duct to heat the cotton as it passes to the cotton exit.

Preferably, the gate means is a horizontally pivoted door which is counterweighted in such a manner that it restricts the necessary entrance of air used for conveying and induces a partial vacuum within the enclosure. The partial vacuum is adequate to pull hot air from an air heater through the heating duct into the enclosure where it becomes a substantial portion of the conveying air.

The principal object of this invention is to provide a simple and inexpensive apparatus for introducing hot air into a pneumatic conveying system.

Another object is to introduce such hot air without the use of a rotary air lock.

Another object of this invention is to introduce hot air without significantly increasing the horsepower required.

Another object is to introduce hot air without the use of a fan in the air heater.

Another object is to introduce hot air and retain the ability to reject the admission of rocks, green bolls and other heavy objects into the pneumatic conveying system.

Another object is to provide a simple means of adjusting the distribution of seed cotton going into two streams of precleaning equipment in the cotton gin.

Another object is to accomplish the above objects with apparatus which has few moving parts, is economical to build and is easy to maintain.

Additional objects, features and advantages will be apparent in the written description which follows.

DESCRIPTION OF THE PREFERRED EMBODIMENT

Figure 1:
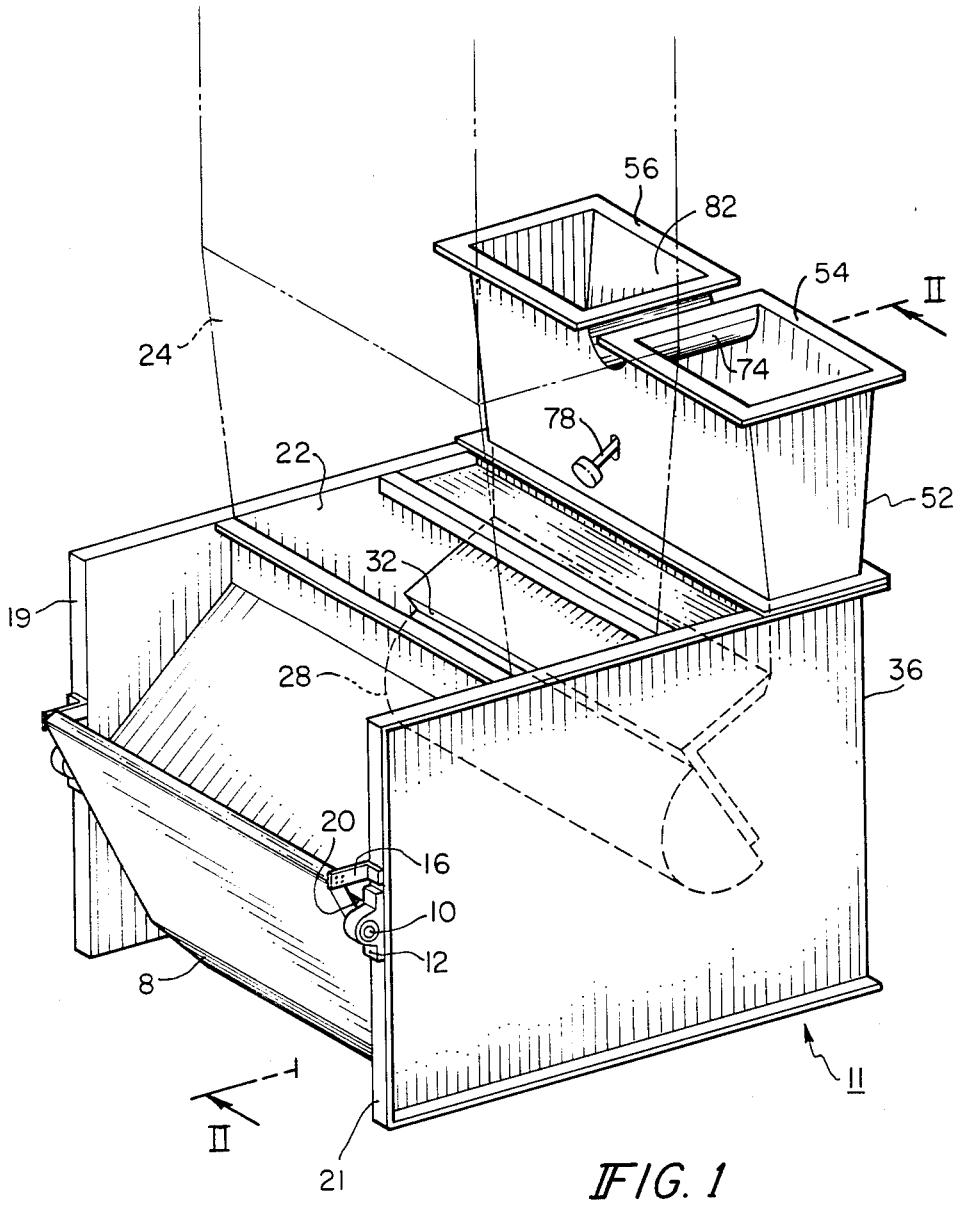
FIG. 1 is a perspective view of the device of the invention showing certain of the internal components in dotted lines.

FIG. 1 shows a hot air induction box 11 of the invention. The box 11 is used to heat seed cotton which is being transported by the conveyor along a path, typically to the precleaning equipment of a cotton gin. FIG.

2 is a side, partial sectional view of the induction box of the invention installed over a conveyor belt 4. The induction box 11 includes an enclosure surrounding a portion of the path used by the conveyor, the enclosure having sidewalls which define a closed interior 13, an entrance opening 6, and a cotton exit 34. Preferably, the enclosure has a slanted front wall 17 containing the entrance opening, a rear wall 36 separated by opposing sides 19, 21 (FIG. 1) from the front wall, and a top 15. Suction means are connected to the exit 34 of the enclosure for pneumatically drawing seed cotton from the conveyor, through the enclosure and out the cotton exit 34.

Figure 2:
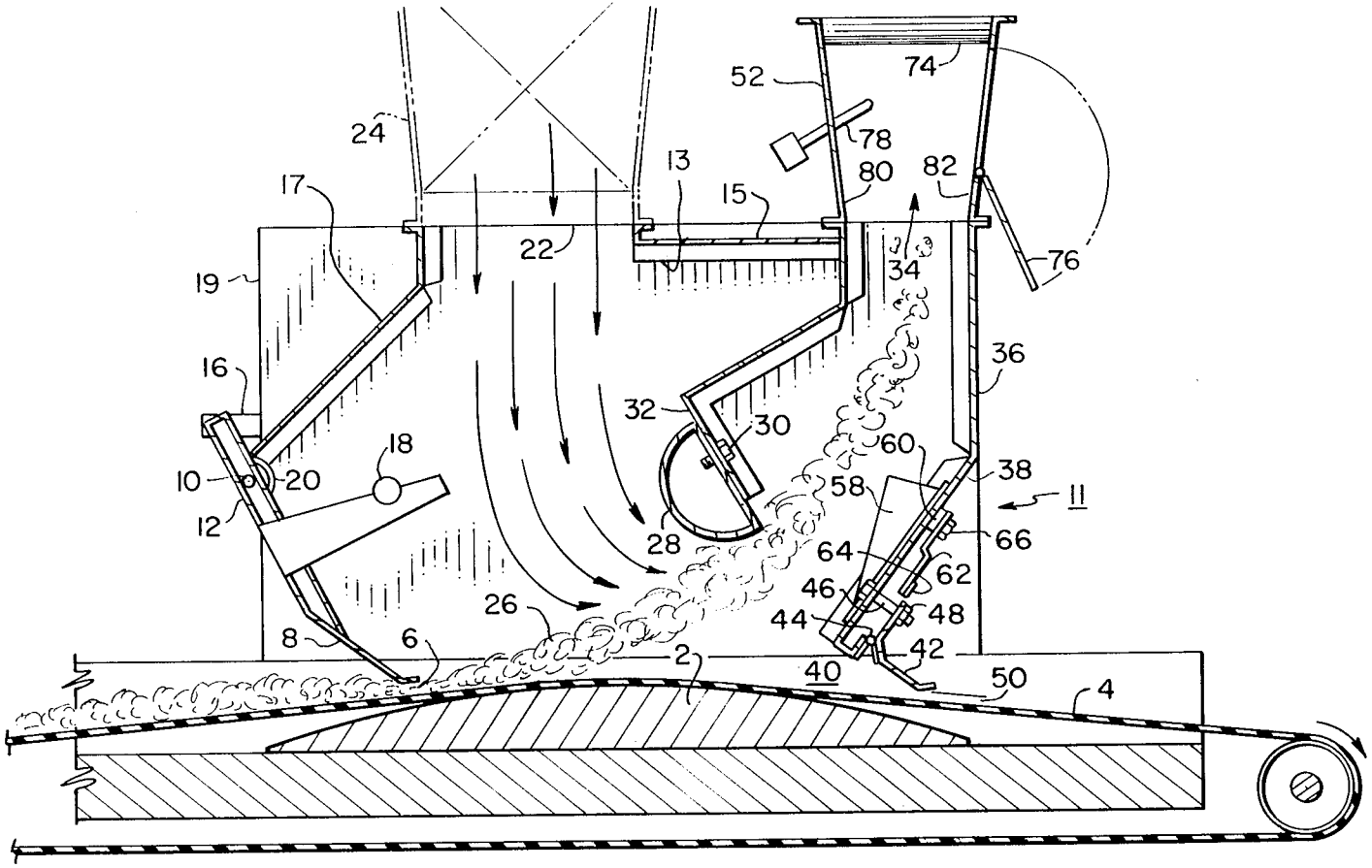
FIG. 2 is a side view, partially in section of the device of the invention in place on a belt conveyor.

As seen in FIG. 2, the path taken by the conveyor belt 4 defines a generally horizontal plane prior to entering the device of the invention. Because a partial vacuum will be induced within the induction box and therefore in the air immediately above the belt, the belt will tend to be drawn upward in an unstable manner. In order to counter this tendency of the belt 4, a gentle arch 2 made of smooth metal such as stainless steel is placed below the belt. The tension in the belt 4 will hold it firmly down against the arch 2 and prevent its being drawn upward and whipped about.

The entrance opening 6 through which seed cotton and foreign material enters the box is formed between the belt 4 and the horizontally pivoted door 8. The door 8 has, passing through it, a horizontal shaft 10 the ends of which pass through two bearings 12 which are affixed to the side frames 19, 21 of the hot air induction box. In order to keep the door 8 from dragging on the belt 4, two stops 16 are bolted to each side of the door 8 and stop its downward travel when they come in contact with the side frames 19, 21. The adjustable counterweight 18 holds the door in its closed or restricted position. Increasing the distance of the counterweight 18 from the shaft 10 increases the doors closing torque and increases the induced vacuum. The door seal 20 is a piece of metal formed to a cylindrical shape concentric with the shaft and welded to the door. Its purpose is to restrict the inward leakage of air around the shaft 10.

As previously stated, a partial vacuum is formed within the hot air induction box. This vacuum serves to pull in hot air through the hot air supply opening 22 from the hot air supply duct 24, which is connected to a commercially available air heater, not shown. The heater will normally be of the type which allows atmospheric air to pass through a burner so that the products of combustion heat the air directly. No fan is necessary to impel the movement of this hot air. Atmospheric air enters the heater through a screen to prevent the formation of sparks from airborne lint and combustible trash.

The inducted hot air travels downward toward the moving belt 4. It mixes with seed cotton 26 and atmospheric air which is pulled in through the opening 6. As shown in FIG. 2, a moveable choke 28 is positionable within the enclosure between the entrance opening 6 and the cotton exit 34. The mixture of hot air, atmospheric air and seed cotton must pass beneath the moveable choke 28. The position of the choke may be adjusted vertically by loosening the cap screws 30 which secure the choke to the inclined choke support 32. The cap screws 30 pass through slots in the choke support 32 which allow vertical movement of the choke 28. This adjustment can produce optimum air velocity between the choke and the belt regardless of the volume of air being used to convey the mixture into the cotton gin through the exit 34.

The hot air induction box has a rear wall 36 having a lower portion 38 which is inclined from the vertical at an angle between 30 and 45 degrees. Since the mixture of seed cotton and air is passing below the choke 28 with an appreciable velocity, it impinges on the inclined portion 38 and is directed upwardly in close proximity to the rear wall 36 until it is captured by the air being drawn into exit 34. Some of the seed cotton, and especially the heavier pieces of foreign matter, will fall into the space 40 below the inclined portion of the rear wall and the belt 4. The rear exit gate 42 is attached to the lower portion of the rear wall 38 by a hinge having its center of rotation at 44. The downward rotation of gate 42 is restrained by locknut 48 on threaded rod 46. The gate 42 is thus kept from contact with belt 4 and forms a minimum opening 50, the size of which is adjustable by locknut 48. This opening can be adjusted to admit enough outside air to blow white fluffy seed cotton back into the main stream of seed cotton and air while allowing the heavier portions to continue out the opening with the movement of belt 4. The hinged attachment of gate 42 allows it to swing upward so as to pass large heavy objects without damage and thereafter reassume the desired opening space 50.

Figure 4B:
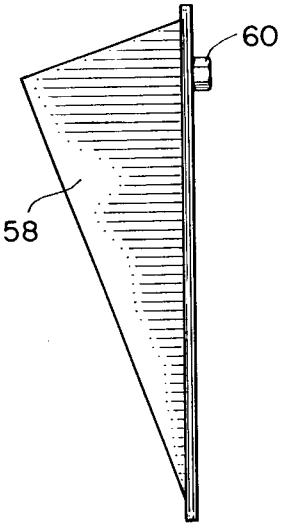
FIG. 4*b* is a side view of the directing vane of FIG. 3*a*.
Figure 4A:
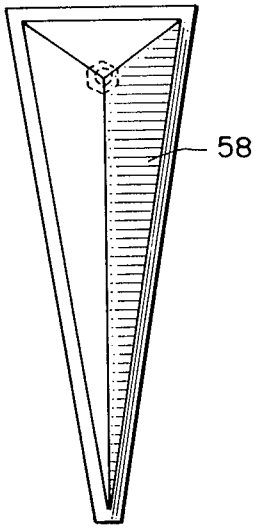
FIG. 4*a* is an isolated, top view of a directing vane used in the device of FIG. 1.

In cotton gins which have their precleaning equipment split into two streams, it is necessary to divide the flow of seed cotton into two streams after it goes through the exit 34. Referring to FIG. 2, the view looking at the rear wall of the hot air induction box, we see the splitter section 52 mounted above the exit 34. The splitter section 52 divides the cotton between two openings 54 and 56 (FIG. 1). It is highly desirable to make an equal division of the seed cotton passing into the two openings 54 and 56 in order to achieve optimum cleaning efficiency. To provide an effective means of adjusting this division, I have provided directing vanes 58 (FIGS. 2, 4*a* and 4*b*) mounted on the inclined rear wall 38. Each vane is welded to a keyed shaft 60 protruding outwardly through the inclined surface 38. Each shaft 60 passes through a keyed hole in an external radius arm 62. The other end of each radius arm 62 is pivotally connected to connecting link 64. It is seen that shifting link 64 in one direction or another will rotate the two vanes 58 about shaft 60 through the same angle in the same direction. Since the stream of seed cotton and air impinges on these vanes, their angular inclination will be quite effective in shifting or biasing the flow toward opening 54 or 56. This method of adjustment is much more convenient than changing the speed of the suction fans connected to each opening or adjusting gate valves in the suction lines. Once the desired adjustment is obtained, cap screws 66 in the center of each shaft 60 may be tightened to retain the adjustment position.

On occasion, it will be necessary to close down one stream of precleaning equipment and run the seed cotton only through the other stream. To facilitate this, a removable diaphragm 68 is shown installed in FIG. 3 to divert the cotton into opening 56 and block off opening 54 so air is pulled only from the hot air induction box and not from the apparatus connected to opening 54. The lower end of the diaphragm 68 is inserted behind the retaining lip 69. Its upper flange is inserted between the clamping bar 70 and the rounded splitter 74. Tightening the locknuts 72 pulls the clamping bar 70 up and holds the diverting diaphragm 68 securely in place. Being of symmetrical configuration, the diverting diaphragm 68 can be used to divert seed cotton into the other stream. It can be inserted quickly through the access door 76 (FIG. 2).

Figure 3:
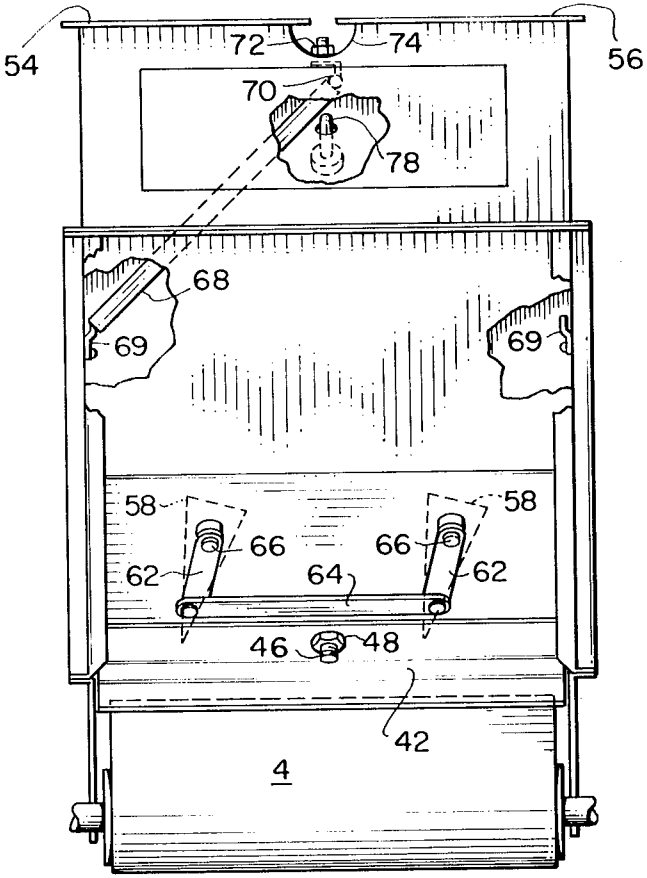
FIG. 3 is a view of the rear sidewall of the device of FIG. 1 showing certain of the internal components.

In order to control the heat input level of the source of hot air, a temperature sensor 78 is located in the splitter section 52 as seen in FIGS. 2 and 3. This will ordinarily be a sensor of the common thermocouple type. When located in this position, it will be effective in sensing the temperature of the air-seed cotton mixture whether the cotton flows into one or the other or both of the openings 54 and 56. Since it is measuring the temperature of the mixture of ambient air which comes in through opening 6 and heated air which comes in through opening 22 and of seed cotton, it is immaterial whether an exact ratio is maintained between the volume of ambient and heated air.

When seed cotton is being picked up, the turbulence produced mixes the ambient and heated air. When no seed cotton is being picked up, the air tends to flow upwardly through the exit 34 in a stratified condition. A layer of cold outside air will be adjacent to side 82 while a layer of hot air will be adjacent to side 80. Locating the sensor 78 as shown will cause it to be hot when no seed cotton is being picked up, and this will decrease the input of heat and save fuel.

An invention has been provided with several advantages. The hot air induction box of the invention provides a simple and inexpensive apparatus for introducing hot air into a pneumatic conveying system. The apparatus has few moving parts and does not require the use of a rotary air lock. The induction principle of the apparatus allows hot air to be introduced without the use of a fan in the hot air heater. The apparatus allows foreign matter, such as rocks, green bolls and heavy objects to be separated from the exiting stream of cotton. The directing vanes on the rear wall of the enclosure provide a simple means of adjusting the distribution of seed cotton going into two streams of precleaning equipment in the cotton gin.

Although I have described installation of the hot air induction box over a belt conveyor, it is apparent that it can also be applied over an inclined chute provided the angle of inclination of the chute is sufficient for the seed cotton to slide to the entrance of the box and adequate for the rocks and green bolls to slide out of the rear end.

Similarly, although the invention has been shown in only one of its forms, it will be apparent to those skilled in the art that it is not so limited, but is susceptible to various changes and modifications without departing from the spirit thereof.

I claim:

1. A hot air induction box of the type used to heat seed cotton which is being transported by conveyance means along a path to a cotton gin, the induction box comprising:

an enclosure surrounding a portion of the path used by the conveyance means, the enclosure having sidewalls which define a closed interior with an entrance opening and a cotton exit;

passage means for connecting said cotton exit to existing external suction means for pneumatically drawing seed cotton from the conveyance path, through the enclosure and out the cotton exit;

a heating duct which connects the enclosure to a source of hot air at atmospheric pressure; and gate means partially restricting the entrance opening so as to be compliant to the entrance of seed cotton but to restrict the entrance of air to thereby create a partial vacuum within the enclosure, the vacuum so created being effective to pull hot air into the enclosure through the heating duct to heat the cotton as it passes to the cotton exit.

2. A hot air induction box of the type used to heat seed cotton which is being transported by conveyance means along a path to a cotton gin, the induction box comprising:

an enclosure surrounding a portion of the path used by the conveyance means, the enclosure having sidewalls which define a closed interior with an entrance opening and a cotton exit;

passage means for connecting said cotton exit to existing external suction means for pneumatically drawing seed cotton from the conveyance path, through the enclosure and out the cotton exit;

a heating duct which connects the enclosure t a source of hot air;

gate means partially restricting the entrance opening to the enclosure to thereby create a partial vacuum within the enclosure, the vacuum so created being effective to pull hot air into the enclosure through the heating duct to heat the cotton as it passes to the cotton exit;

wherein the enclosure has a front wall containing the entrance opening, a rear wall separated by opposing sides from the front wall, and a top, and wherein the gate means is a horizontally pivoted door partially covering the entrance opening, the door being contacted by seed cotton entering the enclosure to thereby pivot the door about a horizontal axis, the door being provided with a counterweight to oppose the entering seed cotton passing into the entrance opening to thereby restrict the entrance of atmospheric air and induce a partial vacuum within the enclosure.

3. The hot air induction box of claim 2, wherein the source of hot air includes an air heater of the type which allows atmospheric air to pass through a burner so that the products of combustion heat the air directly without the use of a fan to impel the movement of the air, the partial vacuum created within the enclosure by the action of the horizontally pivoted door being effective to pull hot air from the hot air source through the heating duct to the enclosure.

4. A hot air induction box of the type used to heat seed cotton which is being transported by a conveyor belt along a path to a cotton gin, the induction box comprising:

an enclosure surrounding a portion of the path used by the conveyor belt, the enclosure having a front wall containing an entrance opening for the conveyor belt, a rear wall separated by opposing sides from the front wall and having a conveyor belt exit, a cotton exit and a top;

passage means for connecting said cotton exit to existing external suction means for pneumatically drawing seed cotton from the conveyor belt, through the enclosure and out the cotton exit;

a heating duct which connects the enclosure to a source of hot air;

a horizontally pivoted door partially covering the entrance opening, the door being contacted by seed cotton entering the enclosure on the conveyor belt to thereby pivot the door about a horizontal axis, movement of the door being effective to create a partial vacuum within the enclosure, the vacuum so created being defective to pull hot air into the enclosure through the heating duct to heat the cotton as it passes to the cotton exit; and a moveable choke positionable within the enclosure between the entrance opening and the cotton exit to vary the size of the cotton exit to thereby vary the air velocity of the air used to convey seed cotton through the enclosure.

5. A hot air induction box of the type used to heat seed cotton which is being transported by a conveyor belt along a path to a cotton gin, the induction box comprising:

an enclosure surrounding a portion of the path used by the conveyor belt, the enclosure having a front wall containing an entrance opening for the conveyor belt, a rear wall separated by opposing sides from the front wall and having a conveyor belt exit, a cotton exit an a top;

passage means for connecting said cotton exit to existing external suction means for pneumatically drawing seed cotton from the conveyor belt, through the enclosure and out the cotton exit;

a heating duct which connects the enclosure to a source of hot air;

a horizontally pivoted door partially covering the entrance opening, the door being contacted by seed cotton entering the enclosure on the conveyor belt to thereby pivot the door about a horizontal axis, movement of the door being effective to create a partial vacuum within the enclosure, the vacuum so created being effective to pull hot air into the enclosure through the heating duct to heat the cotton as it passes to the cotton exit; and wherein the seed cotton entering the enclosure comprises cotton and heavier foreign matter and wherein the rear wall of the enclosure has a lower portion which is inclined from the vertical to direct seed cotton on the conveyor belt which impinges thereon vertically upward through the enclosure, the heavier foreign matter continuing on the conveyor belt out the conveyor belt exit, the inclined rear wall portion of the enclosure being provided with directing vanes for dividing the cotton passing vertically upward along the rear wall portion into two equal divisions.

6. The hot air induction box of claim 5, wherein the rear wall lower portion includes a hinged exit gate which is hung at a predetermined opening size to allow further control of the atmospheric air entering the enclosure.

7. The hot air induction box of claim 5, wherein the cotton exit is a duct divided into two duct openings, the duct openings being arranged to receive equal divisions of cotton passing the directing vanes, the exit duct being provided with a removable diaphragm to divert cotton into one or the other of the two respective duct openings.

8. A method of heating seed cotton which is being transported by non-pneumatic conveyance means along a path to a cotton gin, comprising the steps of:

surrounding a portion of the path used by the conveyance means with an enclosure, the enclosure having sidewalls which define a closed interior with an entrance opening and a cotton exit;

providing passage means for connecting said cotton exit to existing external suction means for pneumatically drawing seed cotton from the conveyance path, through the enclosure and out the cotton exit;

connecting the enclosure to a source of hot air at atmospheric pressure; and utilizing gate means which selectively restrict the entrance opening to the entrance of air but remain compliant to the entrance of cotton to thereby create a partial vacuum within the enclosure, the vacuum so created being effective to pull hot air into the enclosure through the heating duct to heat the cotton as it passes to the cotton exit.

* * * * *